US009950410B2

(12) United States Patent
Dvorscak

(10) Patent No.: US 9,950,410 B2
(45) Date of Patent: Apr. 24, 2018

(54) MAT AND FLOOR COVERING PULLER

(71) Applicant: Peter A. Dvorscak, Nokesville, VA (US)

(72) Inventor: Peter A. Dvorscak, Nokesville, VA (US)

( * ) Notice: Subject to any disclaimer, the term of this patent is extended or adjusted under 35 U.S.C. 154(b) by 288 days.

(21) Appl. No.: 14/271,448

(22) Filed: May 6, 2014

(65) Prior Publication Data

US 2014/0333080 A1 Nov. 13, 2014

Related U.S. Application Data

(60) Provisional application No. 61/855,000, filed on May 6, 2013.

(51) Int. Cl.
*B25B 7/00* (2006.01)
*B25B 7/02* (2006.01)
*B25B 9/00* (2006.01)

(52) U.S. Cl.
CPC ..... *B25B 7/00* (2013.01); *B25B 7/02* (2013.01); *B25B 9/00* (2013.01)

(58) Field of Classification Search
CPC ..... C03B 35/20; B66C 1/422; Y02E 60/12; B25B 9/02; B25B 9/00; B25B 7/00; B25B 7/02; A47G 21/103; A47G 21/10; B25J 15/0009; B25J 1/00; H01L 21/68707
USPC ..... 294/118
See application file for complete search history.

(56) References Cited

U.S. PATENT DOCUMENTS

| | | | | |
|---|---|---|---|---|
| 923,376 | A * | 6/1909 | Savage | 294/22 |
| 1,949,452 | A * | 3/1934 | Roy | 294/118 |
| 4,215,889 | A * | 8/1980 | Rayburn | 294/118 |
| 5,209,538 | A * | 5/1993 | Gabruel | 294/118 |
| 5,871,242 | A * | 2/1999 | Whitney | 294/16 |
| D486,710 | S * | 2/2004 | Whitney | D8/51 |
| 7,537,255 | B2 * | 5/2009 | Key et al. | 294/198 |

* cited by examiner

*Primary Examiner* — Stephen Vu
(74) *Attorney, Agent, or Firm* — William H. Holt

(57) ABSTRACT

A puller for gripping a mat, or pad, and the like for aiding in the movement and placement thereof, the puller including a plurality of pivoted lever members and gripper members mounted thereon for securely gripping the mat or pad, and including at least one handle member for moving the lever members toward and away from each other for moving the gripper members into and out of contact with the mat or pad.

5 Claims, 3 Drawing Sheets

MAT AND FLOOR COVERING PULLER

Priority is claimed based upon U.S. Provisional Patent Application 61/855,000, filed on May 6, 2013.

BACKGROUND OF THE INVENTION

Mats, pads, carpets and other types of floor coverings formed of light to heavy weight materials, for example, fabric, rubber, plastic, plywood and the like have many uses. Examples include tarpaulins for covering baseball infields, yoga mats, Olympic size floor exercise mats, and heavy rubber, or rubber-like, mats for lining the floor of cages in zoos, or the floor in trailers or vans for transporting horses or other large animals, or floors of stables, or pathways in barns for protecting horse's and other animal's hooves from injury caused by cement or other hard surfaces. Rubber mats of this type, in somewhat standard sizes, can vary in thickness between ¼" and ¾" and weigh between 40 and 100 pounds.

SUMMARY OF THE INVENTION

It can be very difficult to move or drag heavy flooring materials, particularly those of large square footage, from one location to another because of the weight and the friction involved. The present invention comprises a puller device and provides an apparatus for securely grasping a mat, or pad, or carpet, or tarpaulin, or plywood, or similar sheet material, to assist a person or persons to pull or drag such articles into, or from, a particular location. One useful process involves removing heavy rubber mats, or pads, from a horse van or horse stall for purposes of periodically cleaning the mat or pad.

DETAILED DESCRIPTION OF THE INVENTION

FIGS. 1-4 show a first embodiment or a puller implement, generally indicated by the numeral 10, which is useful for gripping upon and moving various sheet material in the form of a mat, or pad, or carpet, or tarpaulin, or plywood, or similar sheet material.

Figure 1:
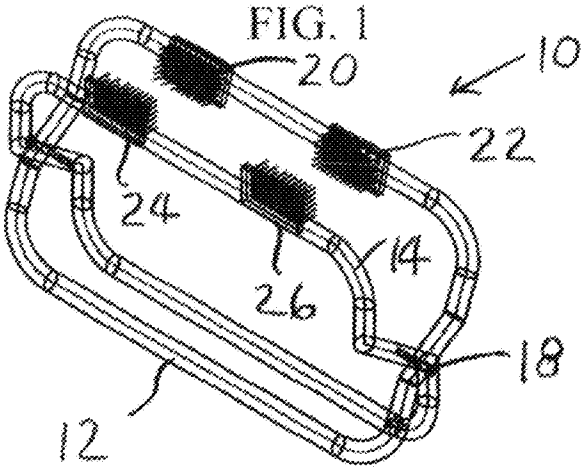
FIG. 1 is a perspective view of a puller comprised of a pair of generally rectangular, inner and outer frames having a plurality of grippers secured thereto for grasping and holding sheet material.
Figure 4:
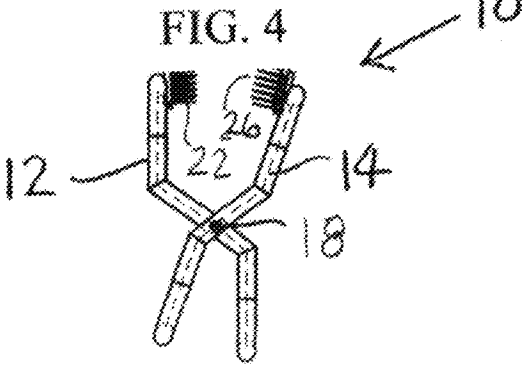
FIG. 4 is a side elevation view of the puller shown in FIG. 1 with the grippers in an open position.
Figure 2:
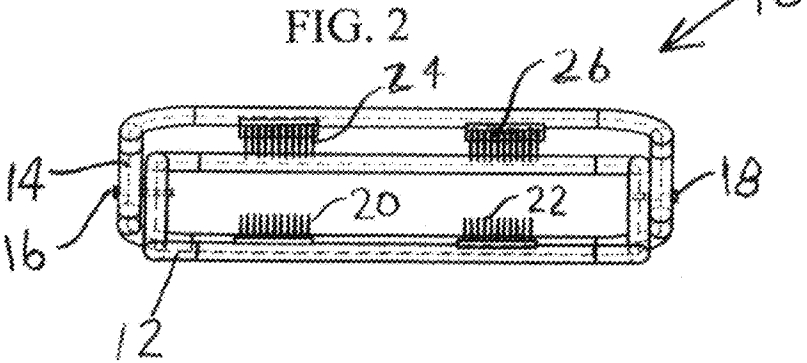
FIG. 2 is a front view of the puller of FIG. 1.
Figure 3:
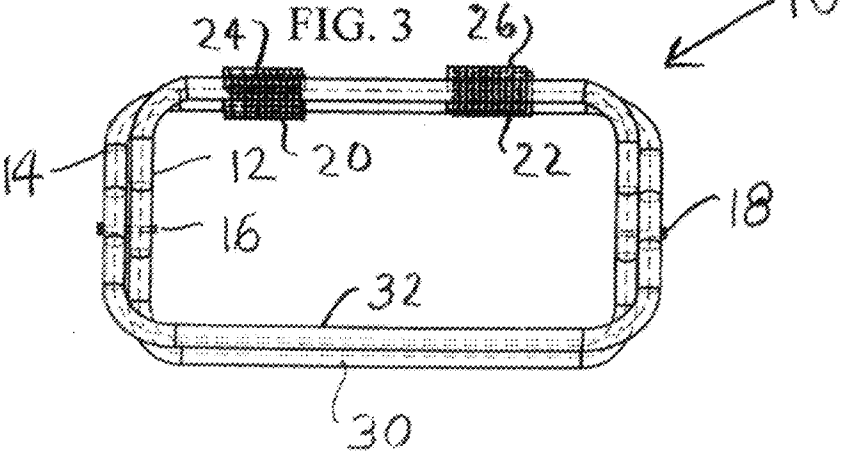
FIG. 3 is a plan view of the puller shown in FIG. 2.
Figure 5:
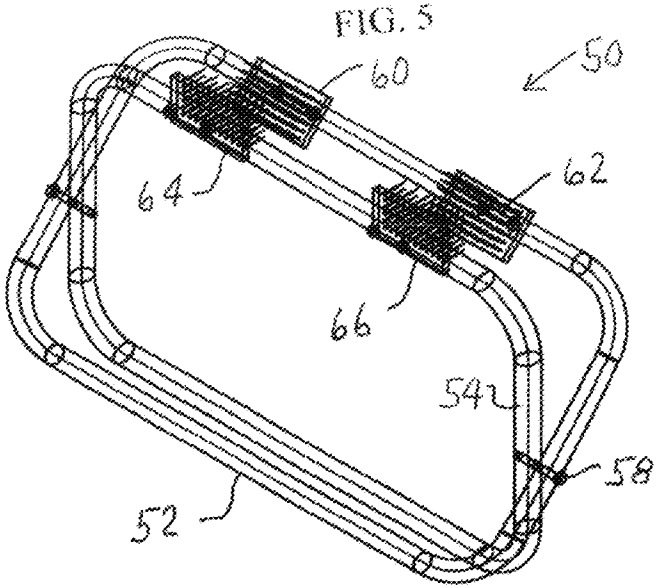
FIG. 5 is a perspective view of a second embodiment of a puller.
Figure 8:
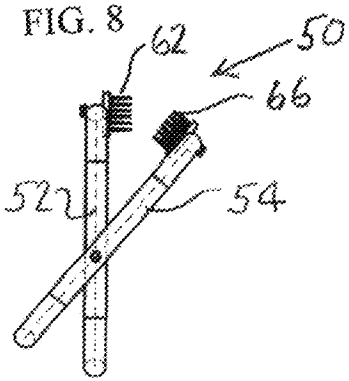
FIG. 8 is a aide elevation view of the puller shown in FIG. 5 with the grippers in an open position.
Figure 6:
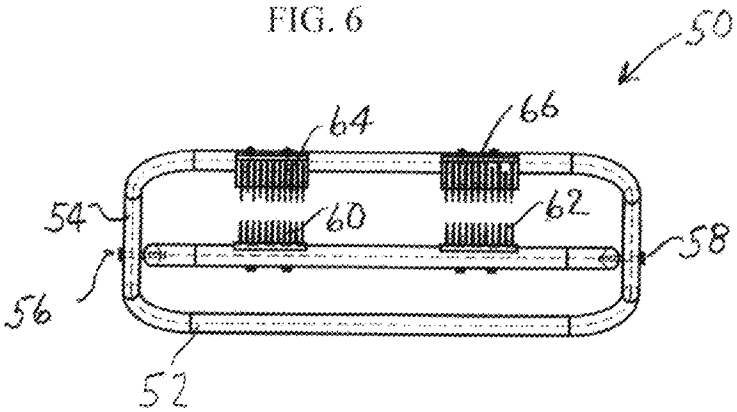
FIG. 6 is a front view of the puller of FIG. 5.

The puller 10 is comprised of a pair of generally rectangular frames 12 and 14. Frame 12 is slightly narrower in width than frame 14 and fits within frame 14, as is best shown in FIG. 3. The frames 12 and 14 are pivotally secured to each other by pivot pins 16 and 18 to provide for relative rotation from an open position to a closed position.

Inner frame 12 includes a pair of grippers in the form of spiked shoes 20 and 22 secured thereto by conventional clamps, screws or bolts which cooperate with similar spiked shoes 24 and 26 which are secured to outer frame 14 in a similar manner. Spiked shoes 20 and 22 are readily detachable from frames 12 and 14 and can be replaced by grippers having different types of gripping surfaces.

Inner frame 12 also includes a handle portion 30 and outer frame 14 includes a handle portion 32. As is best shown in FIG. 3, when handles 30 and 32 are pulled together, the spiked shoes 20 and 22 are closed toward spiked shoes 24 and 26 to grip or grasp a mat, pad, or carper, etc. (not shown) located there between.

FIGS. 5-8 show a second embodiment of a puller implement, generally indicated by the numeral 50, which is useful for gripping and moving various sheet material in the form of a mat, or pad, or carpet, or tarpaulin, or plywood, or similar sheet material.

Figure 7:
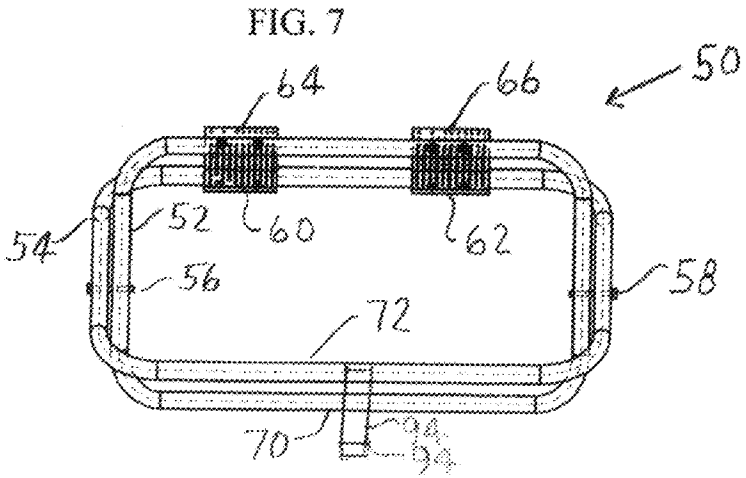
FIG. 7 is a plan view of the puller shown in FIG. 6.

The puller 50 is comprised of a pair of generally rectangular frames 52 and 54. Frame 52 is slightly narrower in width than frame 54 and fits within frame 54, as is best shown in FIG. 7. The frames 52 and 54 are pivotally secured to each other by pivot pins 56 and 50 to provide for relative rotation from an open position to a closed position.

Inner frame 52 includes a pair of grippers in the form of spiked shoes 60 and 62 secured thereto by conventional clamps, screws or bolts which cooperate with similar spiked shoes 64 and 66 which are secured to outer frame 54 in a similar manner. Spiked shoes 60 and 62 are readily detachable in the same manner as shoes 20 and 22 and can be replaced by grippers having different types of gripping surfaces.

Inner frame 52 includes a handle portion 70 and outer frame 54 includes a handle portion 72. As is best shown in FIG. 7, when handles 70 and 72 are pulled together, the spiked shoes 60 and 62 are closed toward spiked shoes 64 and 66 to grip or grasp a mat, pad, or carper, etc. (net shown) located there between.

Comparing FIG. 1 to FIG. 5, and comparing FIG. 4 to FIG. 8 the differences between puller 10 and puller 50 will be seen wherein the side portions of frames 12 and 14 include a bent portion while the side portions of frames 52 and 54 are straight.

The frames 12, 14, 52 and 54 are shown as being comprised of metal tubes preferably formed of aluminum to minimize the weight. It is to be understood however that the frames may be comprised of other materials such as wood or plastic with sufficient strength for pulling on the mats, or pads, etc., and can be formed of bar stock, or flat material, etc.

As mentioned above, it is contemplated that the pullers 10 and 50 are to be used in pulling a mat, or pad, or carpet, or tarpaulin, or plywood, or similar sheet materials. The weight of these sheet materials will, of course, vary depending upon the material and size, i.e., the area and thickness. For example, a rubber mat to be used in horse vans, or stalls, or walkways can vary from about ¼ inch to about ¾ inch, or more, and may be on the order of 10 feet by 15 feet and weigh on the order of 40 to 100 pounds.

As is shown in FIGS. 3 and 7, the frames 12 and 14, and frames 52 and 54 are wider than their depth. It is within the scope of the invention that the distance between the handles 30 and 32 and spiked shoes or grippers 20, 22, 24 and 26, and the distance between the handles 70 and 72, and the spiked shoes or grippers 60, 62, 64 and 66 can be increased to about three feet so that the puller implements 10 and 50 can be used to grip a floor covering, mat, etc., without the need for the user to bend down toward the ground or floor. In addition, it is within the scope of the invention that the grippers or spiked shoes 20 or 60, etc., particularly the ones adjacent the floor or ground, be provided with a thin leading edge, or thin ramp, for assisting easy insertion of the lower grippers or spiked shoes underneath the floor covering or mat without requiring the user to bend down, and without requiring manual handling of the contaminated floor covering or mat.

It is also to be understood that the frames 12 and 14, and 52 and 54 can be comprised of a plurality of parts that are secured together by different processes such as by welding, or be secured by threaded members and fasteners.

Figure 9:
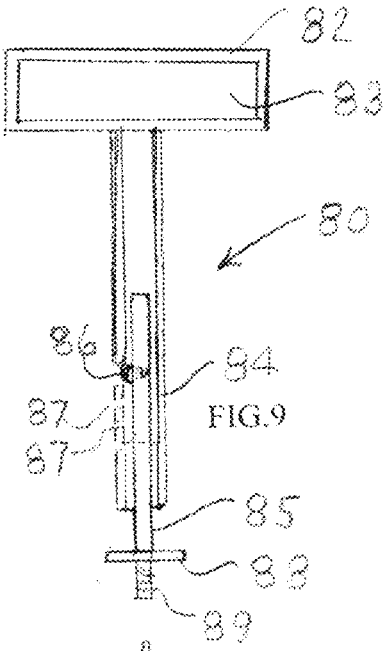
FIG. 9 is an elevation view of an adjustable handle that can be detachably secured to the pullers shown in FIGS. 1-8

FIG. 9 discloses an adjustable handle, generally indicated by the numeral 80, and includes a hand grip portion 82 which is, preferably, wide enough to be gripped by two hands of a person using the device, approximately six inches wide and having an open space 83 of about three inches deep.

Handle 80 is comprised of a pair of hollow shafts 84 which receive therein slidable shafts 85 each which carries a spring leaded button 86 which can be positioned in a series of openings 87 for adjusting the length of handle 80, preferable up to about four feet in length so that the user can work from a standing position. Shaft 85 can be provided with a removable pin 88 and/or a threaded end 89 for fixedly connecting handle 80 to socket members secured to frames 12 and 14, and frames 70 and 72.

Figure 10:
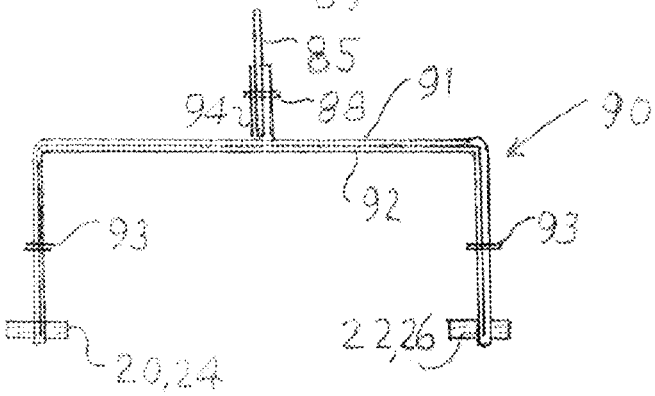
FIG. 10 is an elevation view of a third embodiment of a puller in closed position.

FIG. 10 is a modified form of a frame member 90 comprised of a pair of U-shaped members 91 and 92 which are pivotally connected together by a pair of pins 93. Each of a pair of shafts 88, of handles 80, are secured in tubular socket members 94 on the respective U-shaped members 91 and 92 by removable pins 88. Free end portions of U-shaped members 91 and 93 are each provided with a pair of matching gripper members 20, 22 and 24, 26. When the hand grip portions 82, of the pair of handles 80 are brought together, gripper member 20, 22 and 24, 26 make a secure purchase upon a mat, pad, carpet or tarpaulin disposed between the gripper members.

Figure 11:
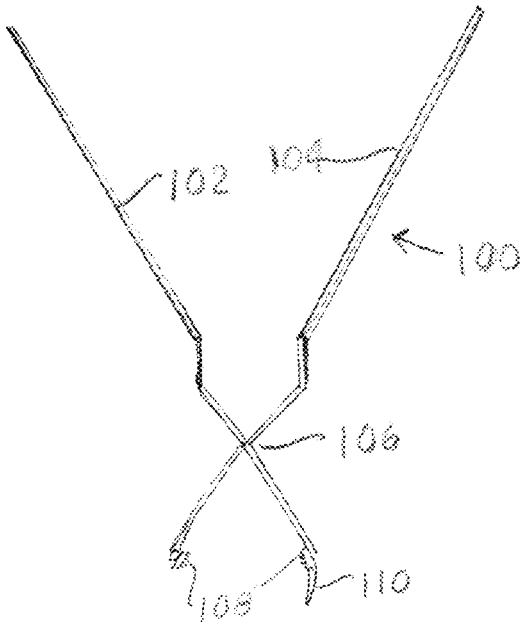
FIG. 11 is an elevation view of a fourth embodiment of a puller shown in open position.

FIG. 11 shoos a further embodiment of a puller, generally indicated by the numeral 100, and comprised of a pair of handles 102 and 104 pivoted together at 106. The free ends of handles 103 and 104 may foe secured in sockets 94 for carrying a frame member 90, as in FIG. 10, or may each have a gripper member 108, similar to grippers 20 and 22 secured thereto. In addition, a thin slider or tong 110 is secured to handle 102, or directly to a gripper member 108, or likewise to the frame members in FIGS. 1-10, for sliding under a mat, pad or carpet, etc., to be readily slid into position between the respective gripper members carried by the various handles and frame members.

The disclosed embodiments and variations thereof are considered to be examples of devices in accord with the invention as defined by the appended claimed subject matter.

I claim:

1. A puller for gripping a mat, or pad, for aiding in the movement and placement thereof, said puller including a plurality of gripper members mounted upon first and second pivoted lever members, said first pivoted lever member having at least one gripper member secured thereto that cooperates respectively to at least one gripper member on said second pivoted lever member, each of said gripper members having gripping surfaces thereon for securely gripping said mat or pad, wherein each of said first and second lever pivoted members comprises a generally rectangular frame.

2. A puller as defined in claim 1 wherein each of said gripper members includes a plurality of spikes for penetrating a surface of said mat or pad for providing a secure purchase thereof.

3. A puller as defined in claim 1 wherein each of said first and second pivoted lever members is comprised of an elongated handle, wherein each of said elongated handles being secured to each of said rectangular frames for moving said at least one gripper member on the first pivoted lever member toward and away from corresponding said at least one gripper member on the second pivoted lever member.

4. A puller as defined in claim 1 including a slider secured to at least one of said first and second pivoted lever members for sliding under said mat or pad for promoting ease in sliding said puller into position for gripping said mat or pad.

5. A puller as defined in claim 1 wherein one of said generally rectangular frames is slightly narrower than another of said generally rectangular frames and fits within said one of said generally rectangular frames, both of said frames being secured to each other by a pair of spaced pivot pins for providing relative rotation from an open position to a closed position.

* * * * *